United States Patent [19]

Wise

[11] Patent Number: 4,538,511

[45] Date of Patent: Sep. 3, 1985

[54] SIGNATURE HANDLING APPARATUS

[75] Inventor: James C. Wise, Jackson Springs, N.C.

[73] Assignee: Harris Graphics Corporation, Melbourne, Fla.

[21] Appl. No.: 525,840

[22] Filed: Aug. 24, 1983

[51] Int. Cl.[3] ..... B65B 13/04

[52] U.S. Cl. ..... 100/7; 100/3; 100/26; 414/43

[58] Field of Search ..... 100/3, 7, 26, 100; 414/43, 110, 907; 53/436, 447, 526, 528, 540

[56] References Cited

U.S. PATENT DOCUMENTS 3,515,056 6/1970 Johnson ..... 100/7 X 3,825,134 7/1974 Stobb ..... 414/43 X

*Primary Examiner*—Billy J. Wilhite

*Attorney, Agent, or Firm*—Yount & Tarolli

[57] ABSTRACT

Sheet material handling apparatus comprising a transfer vehicle movable along a guide track between a stack pickup position and a stack discharge position. The transfer vehicle has a clamping mechanism for clamping a stack of signatures at the stack pickup position and for removing the stack of signatures from the stack pickup position. The clamping mechanism is adapted to maintain clamping engagement with the stack of signatures as the transfer vehicle is moved along the guide track away from the stack pickup position and to the stack delivery position, and the clamping mechanism is releasable from the stack of signatures at the stack delivery position.

16 Claims, 22 Drawing Figures

SIGNATURE HANDLING APPARATUS

BACKGROUND OF THE INVENTION

The present invention relates to the handling of signatures that are delivered from a printing press. It relates particularly to a system in which signatures delivered from the press are formed into stacks, and the stacks are then clamped by a transfer vehicle and transported by the transfer vehicle to a delivery station.

Signatures that are delivered from a printing press are typically formed into stacks, and the stacks are then transported to a tying station where they are tied into logs. If it is desired, end boards may be associated with the stack before it is tied. After the stacks of signatures are tied, they can be loaded onto pallets, taken to a storage location, and later removed from the storage location and delivered to an assembling station where they are collated into magazines and other publications.

In transporting stacks of signatures from a stacking station to a tying station, it is known to use a conveyor. It is also known to use a fork lift truck. However, neither of those techniques maintains a positive clamping of the stack of signatures as it is being transported between the stations. Thus, there is a possibility for the stack to become disarrayed as it is being transported. That problem becomes particularly acute where it is desired to operate the conveyor or the fork lift truck at a high rate of speed.

An alternative to conveying stacks of signatures from a stacking station to a tying station is to provide a separate tying station for each stacking station. However, for printing presses with multiple deliveries, which is common, that alternative is expensive. Also, it requires that each stacking station be designed to handle the situation where the typing station associated with that stacking station fails. Otherwise, failure of one tying station could necessitate shutdown of the entire printing press.

SUMMARY OF THE INVENTION

The present invention handles signatures in a way that avoids the foregoing problems. It provides a transfer vehicle which can (i) move along a guide track to a stack pickup position (e.g., a stacker), (ii) positively clamp a stack of signatures at the stack pickup position, and (iii) transport the stack along the guide track to a delivery position (e.g., a tying station) while maintaining positive clamping of the stack. By maintaining positive clamping of the stack, the possibility of the stack becoming disarrayed while it is being transported is eliminated. Thus, the stack of signatures can be transported at the highest speed the transfer vehicle can operate at.

According to another aspect of the invention, the transfer vehicle includes part of a strap guide, and the tying station includes a cooperating part of a strap guide. When the transfer vehicle is at the tying station, its strap guide part cooperates with the strap guide part on the tying station to define a guide strap which guides a strap around a stack of signatures.

With the preferred embodiment of the invention, signatures from plural press deliveries can be tied at a common, remote location with plural tyers. Thus, each stacking station does not have to be adapted to handle a situation where a tyer fails.

BRIEF DESCRIPTION OF THE DRAWINGS

These and other features of the present invention will become further apparent from the following specification taken together with the accompanying drawings wherein.

DETAILED DESCRIPTION OF THE PREFERRED EMBODIMENT

Figure 1:
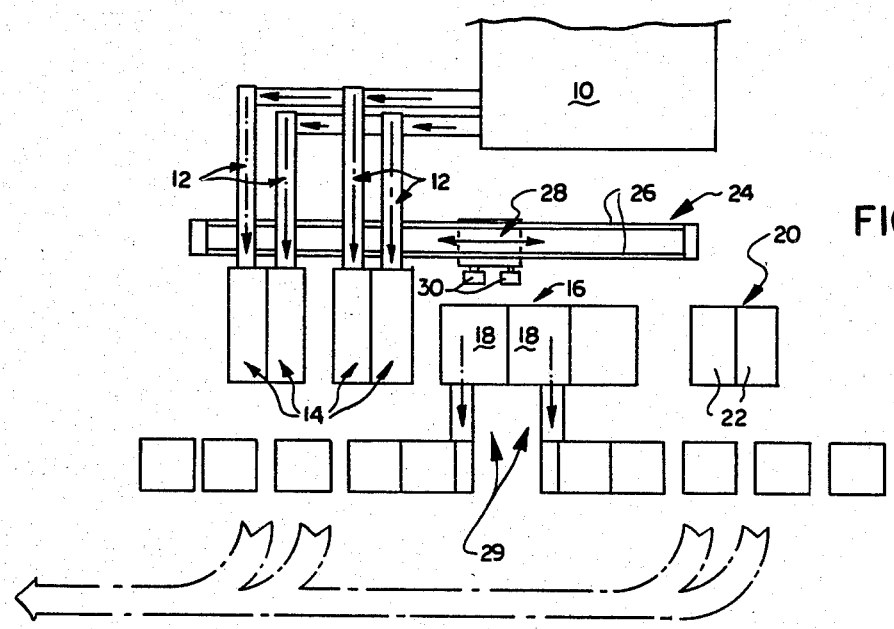
FIG. 1 is a schematic illustration of part of a signature feeding and handling system incorporating apparatus constructed in accordance with the present invention.

FIG. 1 illustrates a system with a printing press 10, a plurality of delivery conveyors 12, each of which delivers signatures in overlapped, shingled fashion from the press 10, and a plurality of adjacent stackers 14, each disposed to receive signatures from a respective one of the delivery conveyors 12. A tying station 16, comprising a pair of tyer mechanisms 18, is disposed adjacent the stackers 14. At the tying station 16, stacks of signatures can be tied into logs or bundles. An end board feeding station 20, comprising a pair of end board feeding mechanisms 22, is disposed adjacent the tying station 16. The end board feeding station 20 contains a supply of end boards that can be picked up by transfer vehicle 28.

A guide track 24, defined by a pair of spaced, parallel rails 26, runs past the foregoing stations, and the transfer vehicle 28 is movable along the guide track 24 between the various stations. The transfer vehicle 28 can (i) pick up pairs of end boards at the end board feeding station 20, (ii) move over to a stack pickup position disposed adjacent a pair of stackers 14, (iii) clamp and remove stacks of signatures from two of the stackers 14 while associating end boards with the stacks, and (iv) transfer the stacks of signatures to the tying station 16 where the stacks of signatures are tied into logs.

The transfer vehicle 28 has a pair of clamping mechanisms 30, each of which can clamp a stack of signatures that are on a stacker 14 and remove the stack of signatures from the stacker. Each clamping mechanism 30 maintains clamping engagement with a stack of signatures as the transfer vehicle 28 moves to the tying station 16. At the tying station 16 a clamping mechanism 30 can be released from the stack of signatures to allow a tied stack of signatures to be removed from the tying station 16 and deposited onto a further transporting conveyor system (shown generally at 29 in FIG. 1). Each clamping mechanism 30 can also pick up end boards at the end board feeding station 20 and bring those end boards over to the stackers 14, where the end boards can be associated with a stacks of signatures.

The transfer vehicle 28 is guided between the stackers 14, the tying station 16, and the end board feeding station 20, by means of the rails 26 that define the guide track 24. The transfer vehicle 28 is suspended from the rails 26 of the guide track 24, and can be moved along the guide path defined by those rails at a varying speed, as set forth in more detail hereinafter.

Figure 2:
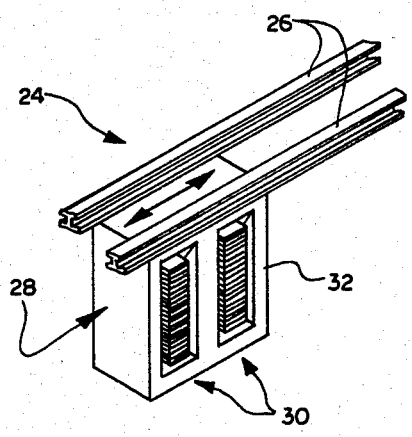
FIG. 2 schematically illustrates a transfer vehicle moving along a guide track with its clamping mechanisms clampingly engaged with stacks of signatures and disposed in retracted positions.
Figure 3:
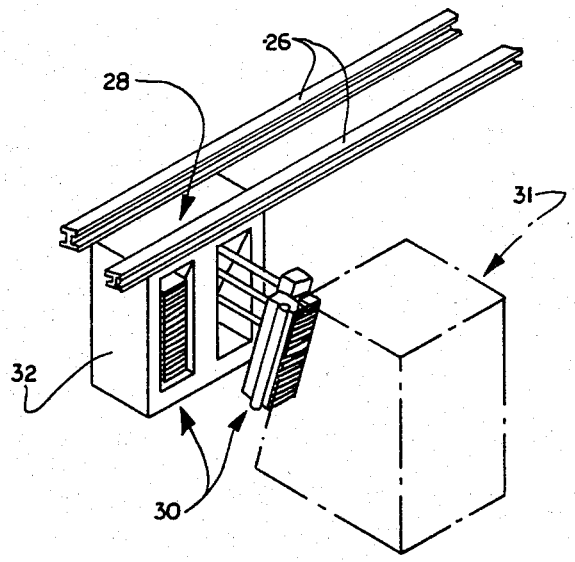
FIG. 3 schematically illustrates the transfer vehicle disposed at an operating station, with one of its clamping mechanisms in an extended position at the operating station.

Each clamping mechanism 30 on the transfer vehicle 28 is disposed in a retracted position when the transfer vehicle 28 is moving between the various stations, and can be moved to an extended position when the transfer vehicle 28 is at an operating station. FIG. 2 schematically illustrates the transfer vehicle 28 moving along the guide track 24 with both of its clamping mechanisms 30 clampingly engaged with stacks of signatures and disposed in their retracted positions as the transfer vehicle 28 moves the stacks of signatures between a pair of operating stations. FIG. 3 schematically illustrates the transfer vehicle with one of its clamping mechanisms 30 in an extended position at an operating station 31 which is shown schematically in phantom.

When the transfer vehicle 28 has moved to a stack pickup position adjacent a stacker 14, a clamping mechanism 30 is moved to its extended position in order to clamp a stack of signatures on the stacker. The clamping mechanism 30 is moved to its retracted position to remove the stack of signatures from the stacker 14. The clamping mechanism 30 remains in its retracted position and maintains clamping engagement with a stack of signatures as the transfer vehicle 28 moves the stack of signatures to the tying station 16. At the tying station 16, the clamping mechanism 30 is moved to its extended position, to place the stack in position to be tied. After the stack of signatures is tied, the clamping mechanism is released from the stack, and is moved to its retracted position, thereby leaving the tied stack at the tying station.

According to the preferred embodiment, the transfer vehicle 28 actually carries a pair of clamping mechanisms 30, and the tying station 16 includes a pair of tyer mechanisms 18. The transfer vehicle 28 can receive two sets of end boards at the end board feeding station 20 carry the end boards over to the stackers 14, remove stacks of signatures from two of the stackers 14, and deliver the two stacks of signatures to respective tyer mechanisms 18 at the tying station 16. At the tyer station 16 both stacks of signatures can be tied into logs, and can then be released for subsequent handling.

With the preferred embodiment, if there is a problem with one of the two tyer mechanisms 18, the transfer vehicle 28 can move back and forth between the two tyer mechanisms 18. Thus, the one operating tyer mechanism can be used with both stacks carried by the transfer vehicle.

Figure 16:
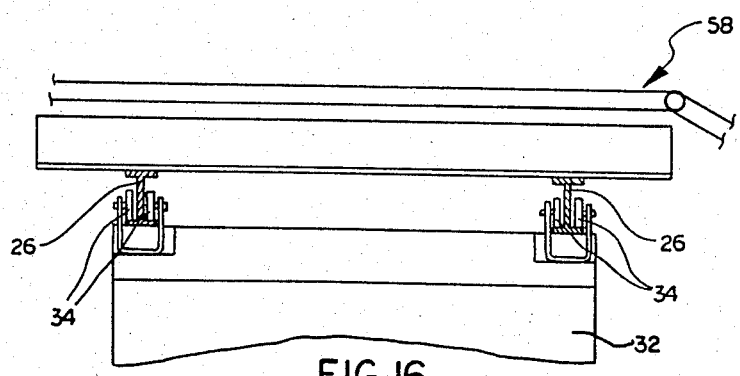
FIG. 16 schematically illustrates the structure for supporting the transfer vehicle for movement along a guide track.

The transfer vehicle 28 and its clamping mechanisms 30 are preferably formed according to the concurrently filed application of Frank Convey entitled "Signature Transfer Vehicle With Stack Clamping Mechanism", U.S. application Ser. No. 518,014, now U.S. Pat. No. 4,498,381, which is assigned to the assignee of this application, and whose disclosure is incorporated herein by reference. The transfer vehicle 28 comprises a carriage 32 that is suspended from the rails 26 by a suspension system which includes rollers 34 that roll along the rails 26 to move the carriage 32 along the rails 26 (see FIG. 16). Each clamping mechanisms 30 is secured to the carriage 32 by longitudinally extending support rods 33 which can reciprocate laterally relative to the path of movement of the carriage 32 to move the clamping mechanism 30 between its extended and retracted positions. An air actuated cylinder 44 can drive the support rods 33 in either lateral direction for moving the clamping mechanism 30 between its extended and retracted positions.

Each clamping mechanism 30 includes a C-shaped frame 36 which is fixed to the support rods 33 and forms an outwardly facing front side 38 through which end boards and/or stacks of signatures can pass. The C-shaped frame 36 includes a back member 37 which is fixed to the movable support rods 33, and top and bottom blocks 39, 41, respectively, which are fixed to the back member 37.

Figure 11:
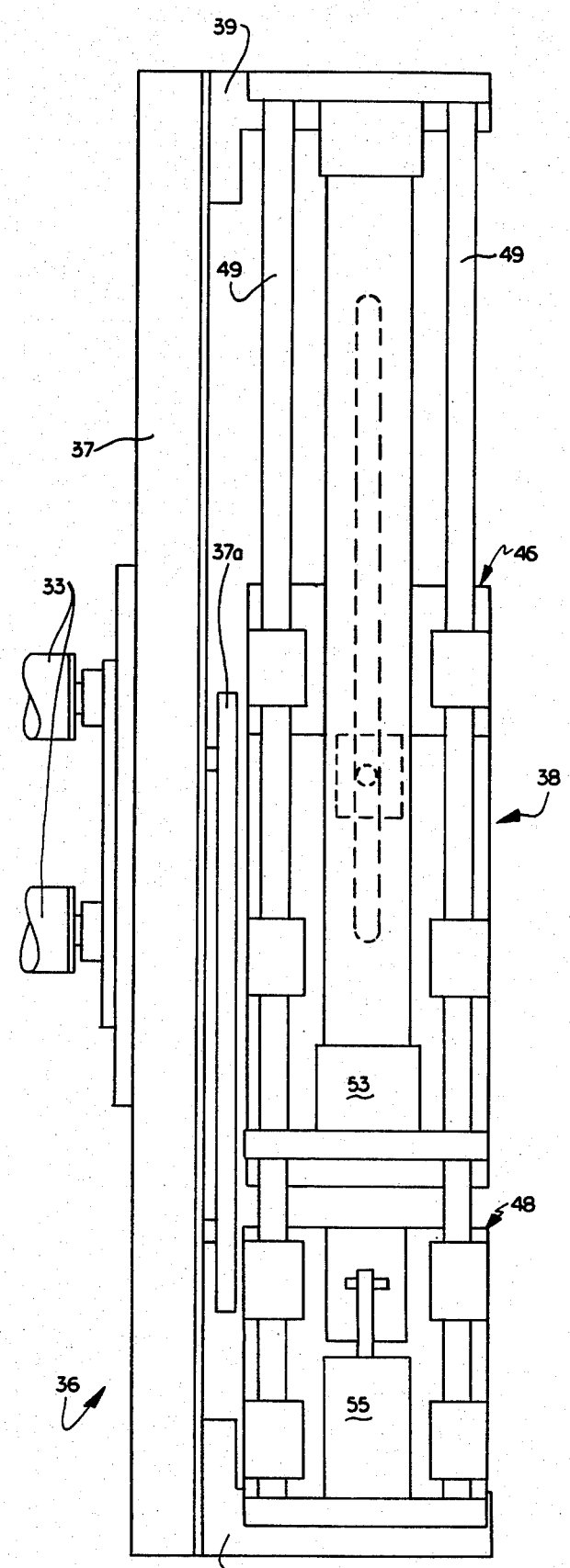
FIG. 11 illustrates one side of a clamping mechanism carried by the transfer vehicle.
Figure 12:
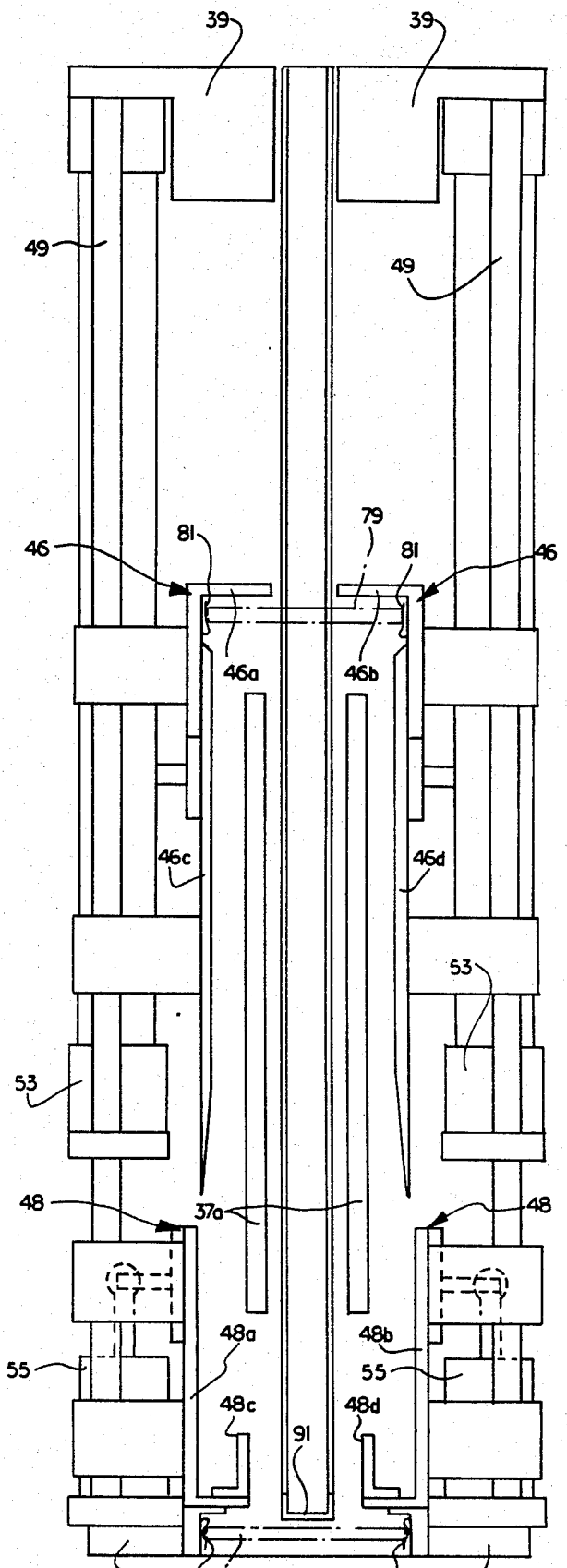
FIG. 12 illustrates the front (signature facing) side of the clamping mechanism.

A movable top clamp assembly 46 and a movable bottom clamp assembly 48 are connected to the C-shaped frame 36. Both clamp assemblies 46, 48 are supported, and guided for linear movement relative to the frame 36, by shafts 49 which extend between the top and bottom blocks 39, 41 (see FIGS. 11, 12). The top clamp assembly 46 preferably comprises a pair of clamp members 46*a*, 46*b*, each of which can be moved linearly along a respective one of the shafts 49 by operation of a respective air cylinder 53 secured to that clamp member. The bottom clamp assembly 48 preferably comprises a pair of clamp members 48*a*, 48*b*, each of which can be moved linearly along a respective one of the shafts 49 by operation of a respective air cylinder 55 secured to that clamp member.

The air cylinder 44 which shifts the clamping mechanism 30 between its extended and retracted positions, and the air cylinders 53 which move the top clamping members up and down, are preferably double acting rodless cylinders of a type manufactured by ORIGA Corporation, Elmhurst, Ill. They are shown in U.S. Pat. No. 3,820,446.

In accordance with the aforesaid application of Frank Convey (Ser. No. 518,014), now U.S. Pat. No. 4,498,381, when a stack of signatures is being clamped, the air cylinders 53 associated with the top clamping members 46*a*, 46*b* are simultaneously actuated, but the top can move their respective clamp members 46*a*, 46*b* can move independently of each other. Thus, the clamp members 46*a*, 46*b* can move independently to apply clamping pressures to different portions of a stack.

Figure 15:
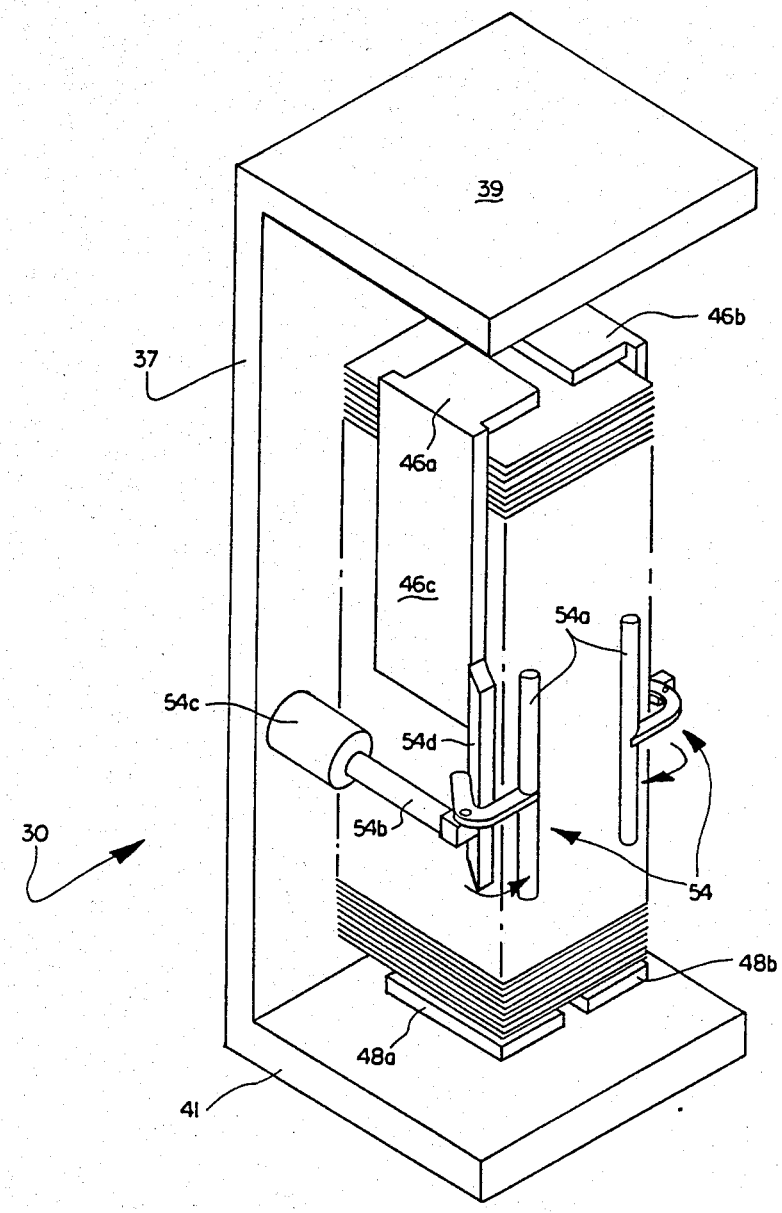
FIG. 15 schematically illustrates a part of the clamping mechanism with a stack of signatures clamped thereon.

In accordance with a still further feature of the aforesaid invention disclosure of Frank Convey (Ser. No. 518,014), now U.S. Pat. No. 4,498,381, the clamping mechanism 30 is designed to completely contain a signature stack after the signature stack has been removed from a stacker 14. Specifically, as can be seen from the foregoing discussion, a back retainer member 37*a* is fixed to the back wall 37 of the frame 36, and contains the back side of a signature stack. The clamp assemblies 46, 48 contain the top and bottom ends of a signature stack. Furthermore, the movable top clamp members 46*a*, 46*b* include integral downwardly depending side retainer members 46*c*, 46*d*, respectively, which contain two opposite sides of a stack of signatures when the stack is clamped between the top and bottom clamp assemblies 46, 48. Finally, to complete the containment, when a signature stack is withdrawn from a stacker, a pair of front gates 54 can be pivoted into positions where they contain the front side of the signature stack. FIG. 15 schematically illustrates a signature stack which is contained on both of its ends and all of its sides by the clamping mechanism 30.

Each of the reciprocable top and bottom clamp assemblies 46, 48 carries a pair of spring fingers 81, each of which can connect an end board with the clamp assembly 46, 48 to allow the the clamping mechanism 30 to carry the end board(s) over to a stack of signatures. One set of the spring fingers 81 extends downwardly from the movable top clamp assembly 46. Another set of the spring fingers 81 extends downwardly from the movable bottom clamp assembly 48. Each pair of spring fingers 81 is biased toward a condition in which it will engage and apply a light gripping force to an end board (e.g., a top end board 79 and a bottom end board 78 as shown in phantom in FIG. 12) and hold the end board as the transfer vehicle 28 moves over to a stacker 14. In accordance with the further principles of the aforesaid application of Frank Convey (Ser. No. 518,014), now U.S. Pat. No. 4,498,381, a lower end board 78 is stripped from the lower clamp assembly 48 and deposited onto the stacker 14 during the clamping of a stack of signatures on the stacker 14, as set forth hereinafter.

Figure 4:
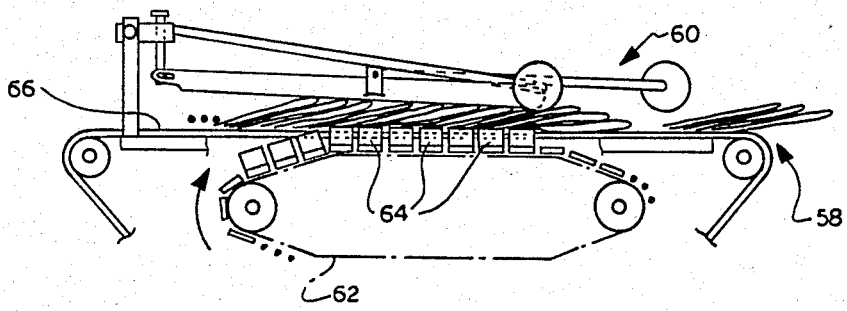
FIG. 4 schematically illustrates apparatus for forming a gap in the signatures being delivered from a printing press to a stacker.

Signatures are delivered by each delivery conveyor 12 to a respective stacker 14 in a shingled, overlapped fashion. As signatures move along a main conveyor portion 58 of a delivery conveyor 12, they pass a gapper 59, a mechanism for creating a gap in the stream of signatures. The gapper 59 is shown in FIG. 4. It is constructed in accordance with application Ser. No. 419,775 filed Sept. 20, 1982, entitled "Stream Gapper Mechanism", which is assigned to the assignee of this application, and whose disclosure is incorporated herein by reference. It includes a retarding roller assembly 60 disposed above the main conveyor 58, and a separator conveyor 62 associated with the main conveyor 58. The separator converyor 62 includes a series of slats 64 which, when the separator conveyor 62 is energized, travel along a path which brings them above the conveying surface 66 of the main conveyor 58. Thus, the slats 64 raise up the signatures being conveyed along the main conveyor 58. The signatures that are raised up then engage the retarding roller assembly 60 which retards the movement of signatures in the stream, while the main conveyor 58 continues to convey the remaining signatures downstream from the retarding roller assembly 60. After a period of time, the slats 64 on the separator conveyor 62 move out of contact with the signatures, thereby allowing them to drop back onto the conveying surface of the main conveyor 58, and resume their movement in a shingled, overlapped stream. However, a gap is now created in the stream of moving signatures.

Figure 5:
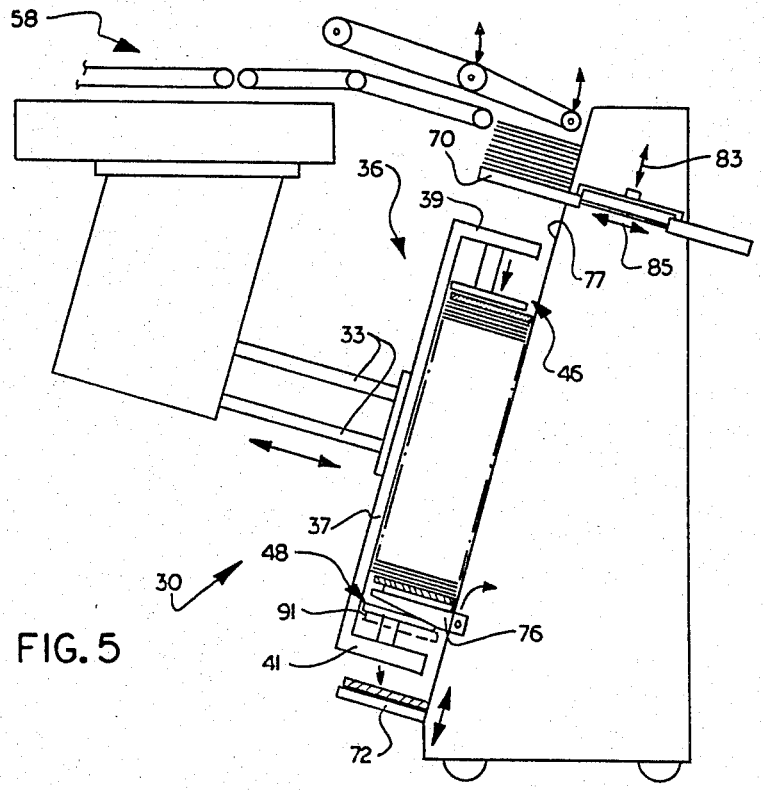
FIG. 5 schematically illustrates a stacker for stacking signatures delivered from a printing press, with a transfer vehicle disposed adjacent the stacker in a stack pickup position.
Figure 10:
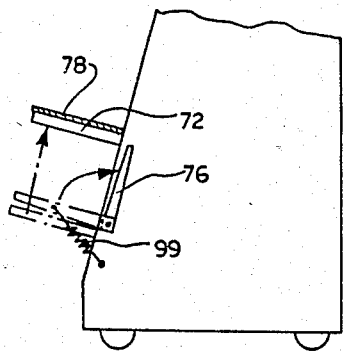
FIG. 10 schematically illustrates the operation of certain portions of a stacker in handling an end board.
Figure 6:
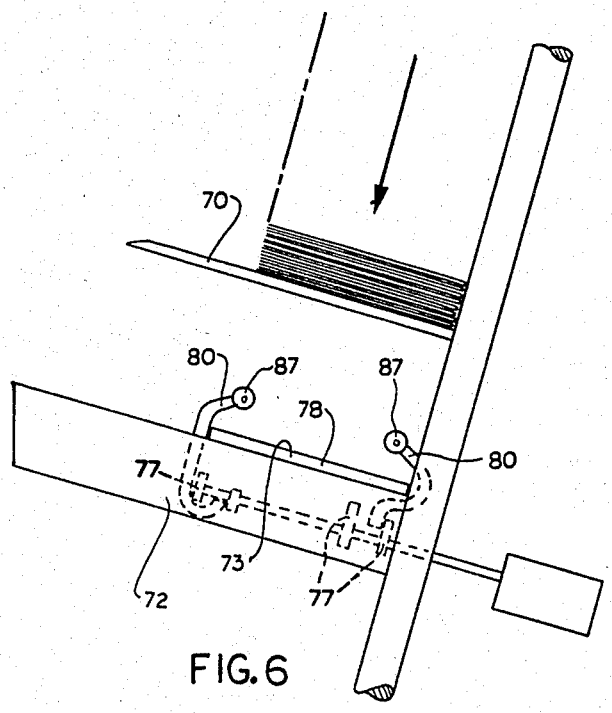
FIGS. 6–9 schematically illustrates operation of certain parts of a stacker in forming a stack of signatures.

One of the stackers 14 is shown in FIG. 5. It is preferably constructed according the concurrently filed application of Mohanjit Chandhoke and Michael Duke entitled "Signature Stacker", Ser. No. 518,015, filed 7-28-83, which is assigned to the assignee of this application, and which is incorporated herein by reference. It includes an interceptor 70, a main fork 72, and an intermediate support member 76, all of which are shown in FIG. 5 at various locations along a slightly inclined, generally upright frame surface 77. The interceptor 70 can move along the frame surface 77, as shown by arrows 83. It can also move transverse to the frame surface 77, as shown by the arrows 85. As the signatures arrive from the main conveyor 58, they begin to form a stack on the interceptor 70. The interceptor 70 can move downward along the frame surface 77 at a rate synchronized with the arrival of signatures so that the top of the stack always remains at about the same level.

The main fork 72 is mounted for reciprocating movement along the inclined frame surface 77, and forms a continuation of the path of the interceptor 70. The main fork 72 is connected with an endless chain 74 which is driven by one of a pair of reversible motors (71, 71*a*) that are coupled to the chain 74 through a clutch and brake assembly 71*b*, and can drive the chain 74 at different speeds. After a partial stack of signatures is formed on the interceptor 70, it is transferred from the interceptor 70 to the main fork 72. The interceptor 70 is withdrawn from the path of the signatures during the transfer and the stack can continue to grow by moving the main fork 72 gradually downward along the inclined frame surface 77. The interceptor 70 is then returned to a position where it can, when directed, move back to its intercept position to intercept signatures from the main conveyor 58, to begin building another stack.

As the main fork 72 moves downwardly with the stack, it transfers the stack of signatures to the intermediate support member 76, which is disposed at a predetermined location along the frame surface 77. The intermediate support member 76 supports the stack of signatures in a position to be engaged by a clamping mechanism 30. After transferring a stack to the intermediate support 76, the main fork 72 continues to move downwardly along the inclined frame surface 77 to a position in which it can receive a lower end board for the next stack of signatures.

The operation of the interceptor 70 is in part controlled by the detection of gaps in the stream of signatures on the main conveyor 58. Specifically, a sensor (e.g., a photocell) senses the presence of a gap in the stream of signatures. The sensor controls the movement of the interceptor 70 so that when a gap is sensed, the interceptor 70 is moved into position to intercept the signatures that are intended to form a successive stack.

The mechanism that initiates creation of a gap in the signature stream is controlled by the sensing of a dimensional characteristic of the stack on the main fork 72. More specifically, a sensor such as a limit switch, photocell, etc., can sense when a stack of a predetermined dimension has been created on the main fork 72. Alternatively, the sensor can be a counter which determines when a predetermined number of signatures have been delivered to the stacker. The sensor energizes the separator conveyor 62 for a predetermined period of time to create a gap in the stream of overlapped signatures.

The manner in which the interceptor 70 transfers a stack to the main fork 72, and the manner in which a lower end board 78 is associated with the bottom end of the stack is shown in FIGS. 6–10. Initially, the intermediate support 76 is pivotally supported on the frame, and is biased by spring 99 to the position shown in full lines in FIG. 10. As the main fork 72 moves upward, the intermediate support 76 is pivoted (cammed) out of the way of the main fork 72 (FIG. 10), to allow the main fork, with a lower end board 78 thereon, to move toward the interceptor 70.

Figure 7:
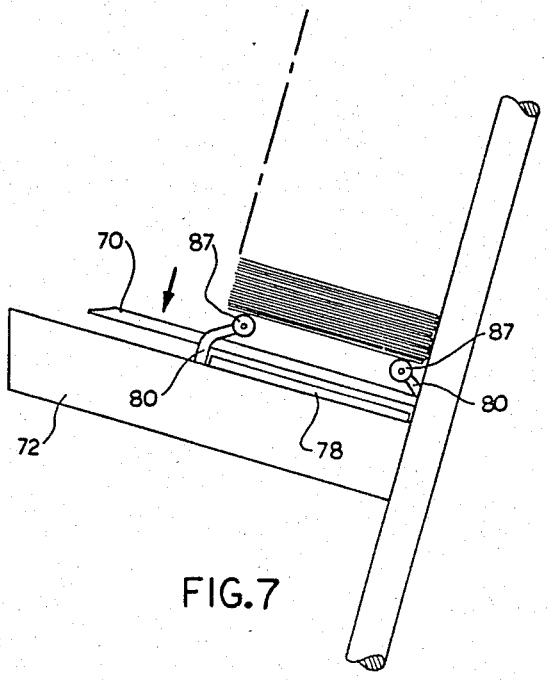
Figure 8:
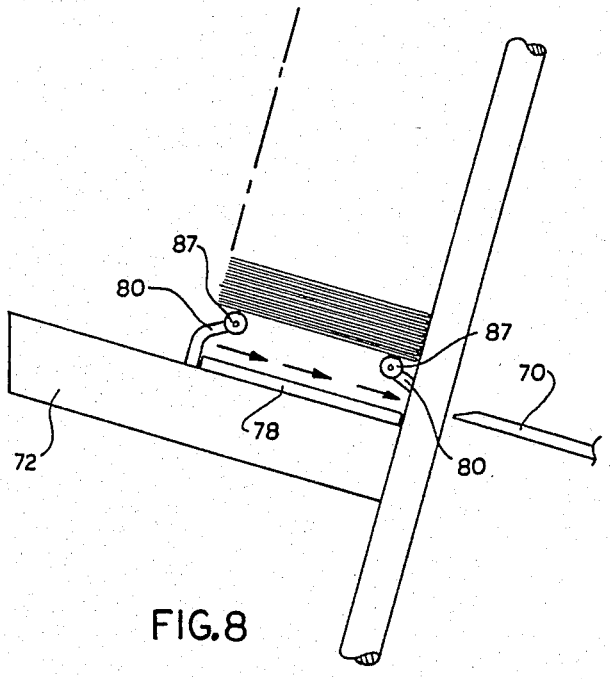
Figure 9:
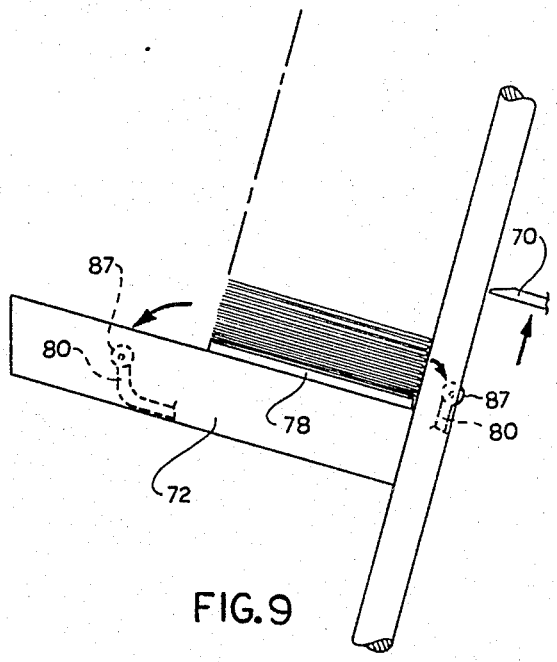

The main fork 72 carries a pair of support arms 80 with rollers 87 at their ends. A linkage, shown schematically in FIG. 6, supports the arms 80 for movement between a first position (shown in FIG. 6) where the rolls 87 are disposed above the upper surface 73 of the fork 72 and a second position (shown in FIG. 9) where the rolls 87 are clear of the upper surface of the fork. The linkage includes an axially movable actuating rod 92 which is controlled by an air cylinder 94. When the fork 72 is carrying an end board 78, and is moved to a stack receiving position for receiving a stack from the interceptor 70, the arms 80 are in their first positions. A lower end board 78 rests on the main fork 72, below the level of the rollers 87. As the interceptor 70 moves downwardly, it moves past the rollers 87 on the stopped main fork 72. The bottom end of a stack of signatures on the interceptor 70 is engaged by the rollers 87 and removed from the interceptor 70. The rollers 87 hold the stack slightly above the lower end board 78 as the interceptor 70 continues to move downwardly (FIG. 7). Then, while the bottom end of the stack of signatures is being held above the end board 78, the interceptor 70 is withdrawn in a direction transverse to the inclined frame surface 77 (FIG. 9). The arms 80 are then pivoted out of engagement with the stack, to allow the bottom end board 78 to directly engage the stack of signatures.

In handling a stack of signatures, the transfer vehicle 28 first moves to the end board pick-up station 20 where it receives pairs of top and bottom end boards 79, 78. The end boards are engaged by the spring finger clamps 81 on the top and bottom clamp assemblies 46, 48. Thus, a top end board 79 and a bottom end board 78 are both connected with the clamping mechanism 30.

Figure 14:
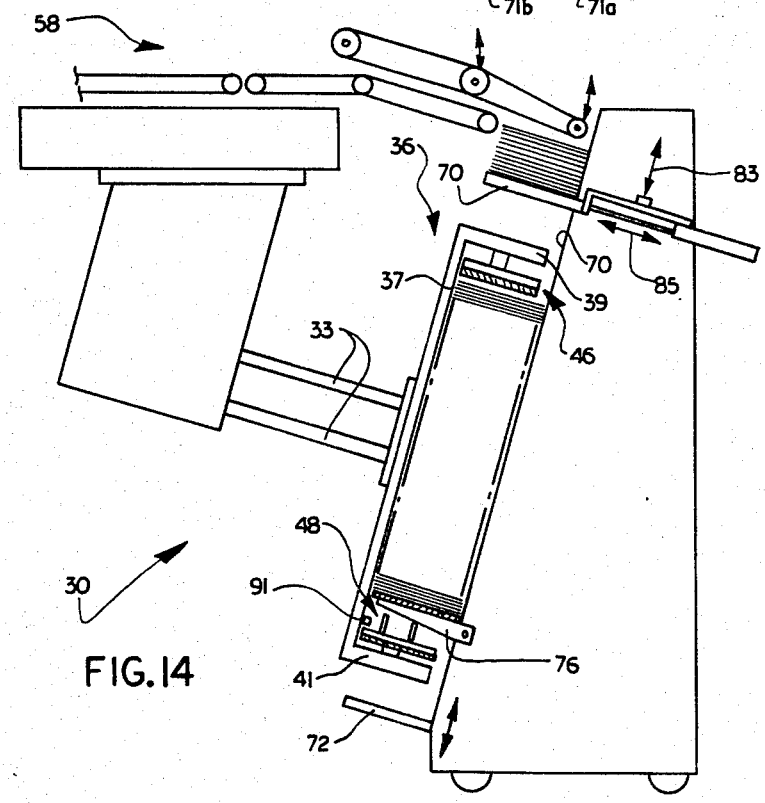

The transfer vehicle 28 then moves along the guide track 24 to a stack pickup position in which the clamping mechanism 30 is aligned with a respective stacker 14 (FIG. 5). At the stacker 14, a stack of signatures and a bottom end board 78 is resting on the intermediate member 76. The clamping mechanism 30 is moved to an extended position, and as that happens, a stack of signatures on the intermediate member 76 of the stacker 14 passes through the front side 38 of the clamping mechanism, and is disposed between the upper and lower clamp assemblies 46, 48 (FIG. 14). The top and bottom clamp assemblies 46, 48 are then moved toward each other in order to clamp a stack of signatures in the stacker 14. More specifically, the movable bottom clamping assembly 48 of the clamping mechanism 30 has upwardly extending fingers **48*c* 48*d* that can interdigitate with the intermediate support 76 that supports the stack on the stacker. As the lower clamp assembly 48 moves upward, the fingers 48*c*, 48*d* move through the intermediate support member 76, and lifts the stack and the bottom end board off the intermediate member 76. Then, air pressure is supplied to the air cylinders 53 which operate the upper clamp members 46*a*, 46*b* of the upper clamp assembly 46, press them downward toward the stack. As the clamp members 46*a*, 46*b* move downward, a top end board 79 is pressed against the top of the stack and clamping the stack between the clamp assemblies 46, 48. Thus, the stack, with a pair of end boards disposed adjacent its ends, is clamped by the clamping mechanism 30**.

As the lower clamp assembly 48 moves upward toward the stack, the lower end board 78, which is carried by the spring finger 81 on the lower clamp assembly 48, engages a stripper member 91 on the C-shaped frame 36, and is stripped from the lower clamp assembly 48. The lower end board 78 is dropped onto the main fork 72, which is disposed at an end board receiving position below the intermediate support 76.

After clamping a stack of signatures, and depositing an end board on the stacker, a clamping mechanism is retracted to remove the stack from the stacker 14 while maintaining clamping engagement with the stack. After the clamping mechanism 30 is clear of the stacker 14, the front retainers 54 are pivoted into the position shown in FIG. 15, to complete the containment of the stack.

After removing a stack from the stacker 14, the transfer vehicle 28 moves the stack to the tying station 16. While the transfer vehicle is moving the stack, the air pressure which operates the clamping assemblies 46, 48 is maintained, and the clamping mechanism 30 maintains clamping engagement with the stack. Thus, there is little, if any, chance for the stack to become disarrayed.

Figure 13:
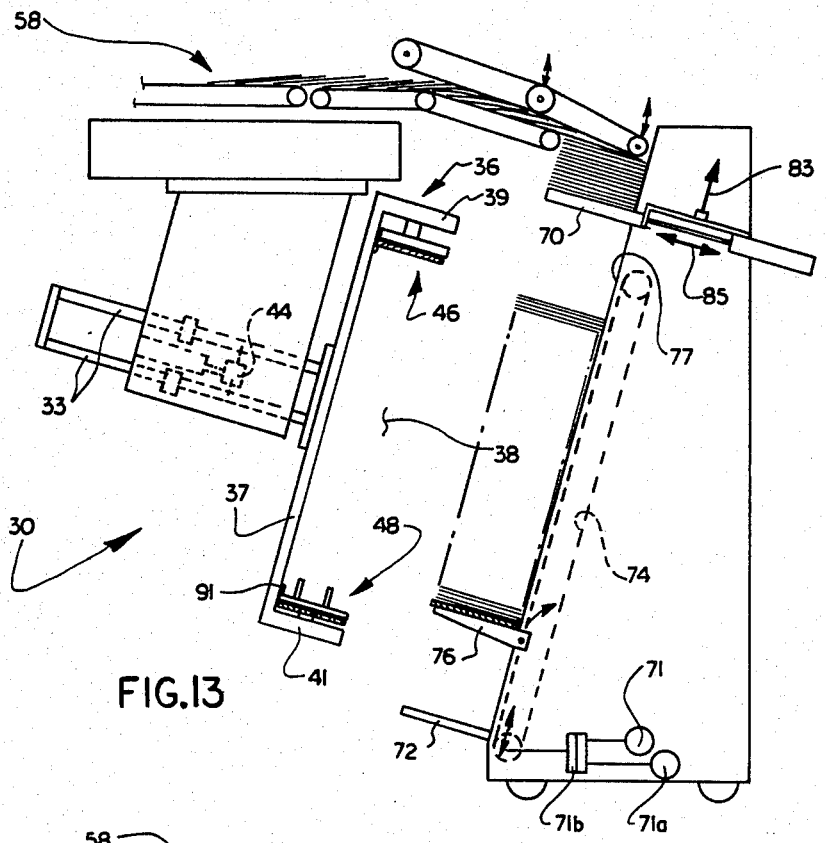
FIGS. 13 and 14 schematically illustrate the operation of a clamping mechanism on the transfer vehicle as it engages a stack of signatures from a stacker.
Figure 19:
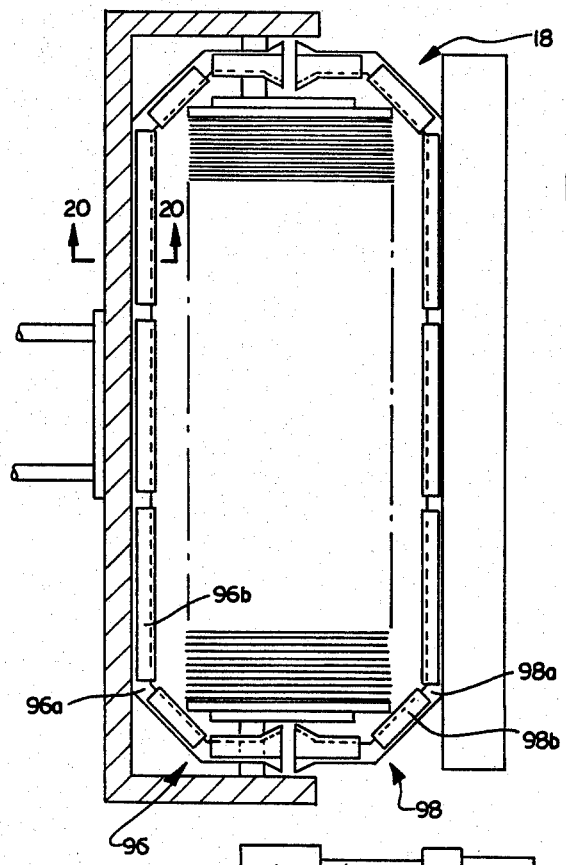
FIG. 19 schematically illustrates the strap guide portions formed on the transfer vehicle and on a tyer mechanism.
Figure 20:
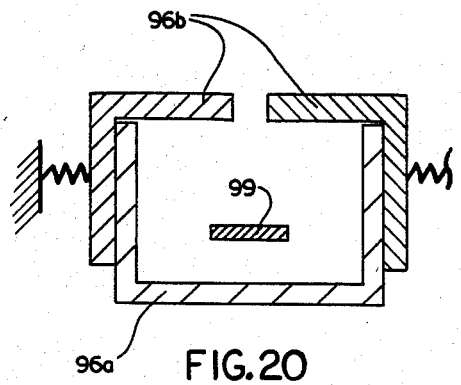
FIG. 20 is a schematic illustration of a section of a guide track part formed on the transfer vehicle or a tyer.

At the tying station 16, a strap guide is formed around the stack, and a strap or band is guided through the strap guide and around the stack and drawn into tight engagement with the stack to tie the stack. According to the present invention, a half portion of the strap guide is carried on the transfer vehicle 28, and other half portion is associated with each tyer mechanism. More specifically, referring to FIG. 19, a C-shaped strap guide part 96 is connected with the transfer vehicle 28. A C-shaped strap guide part 98 is also connected with each tyer mechanism 18. When the transfer vehicle 28 is in a stack delivery position adjacent a tyer mechanism 18, the strap guide part 96 on the transfer vehicle is aligned with, and cooperates with the strap guide portion 98 of the tyer mechanism to define a strap guide extending substantially around a stack of signatures. As seen from FIG. 19, the respective ends of the C-shaped strap guide portions 96, 98 are funnel-shaped, to help guide a strap between the parts. Also, strap guide portions 96, 98 comprise fixed guide parts **96*a*, 98*a*, and yieldable parts 96*b*, 98*b* (FIG. 20) that, during tightening, allow a strap 99 to be forced therethrough. Finally, it should be noted that the stripper finger, shown schematically at 91 in FIGS. 13, 14, in fact comprises the horizontally extending portion of the fixed strap guide part 96***a*.

The strap tightening apparatus is preferably of a type manufactured by Signode Corporation. It includes drive means that draw the strap from a reel, and force it through the strap guide and around the stack. When the strap completely encircles the stack and then overlaps itself, the overlapping portion is gripped and held, while the drive means is reversed. Thus, the strap is tightened. The gripping mechanism is further designed to fuse the overlapped ends, and to cut the tightened strap.

After a stack is successfully tied, the clamping mechanism 30 releases the tied stack, and the clamping mechanism 30 is retracted from the tied stack. Thus, the tied stack is left on the tyer mechanism 18. It can then be removed from the tyer mechanism 18, and delivered to the further handling system 29.

Figure 17:
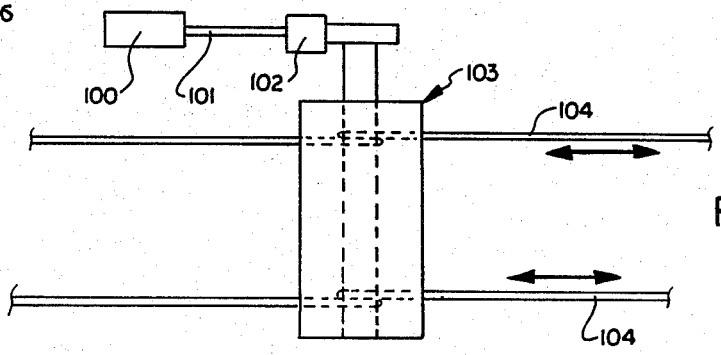
FIG. 17 schematically illustrates the drive mechanism which propels the transfer vehicle along the guide track.

It is contemplated that the trasfer vehicle 28 can be moved along the track in various ways. A preferred mechanism for moving the transfer vehicle 28 along the guide track 15 is shown in FIG. 17. An air motor 100 can drive a linear actuator 101 in either of two directions. In turn, the actuator 101, through a gear box 102, turns a shaft disposed within a drum 103 in one direction. Depending on which way the shaft turns, a pair of bands 104 are wound in one direction and payed out in the other direction, so that the transfer vehicle is effectively pulled in either direction.

Figure 18:
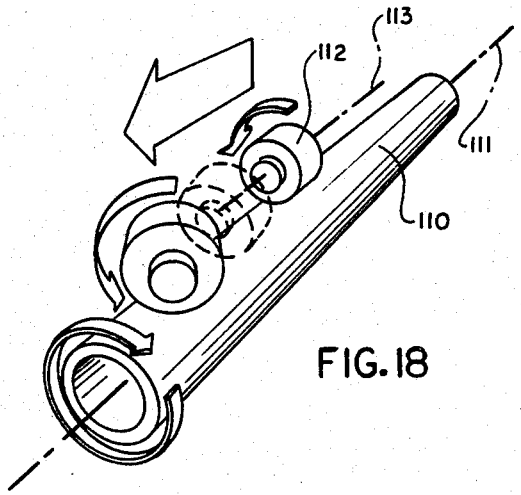
FIG. 18 schematically illustrates the operating principles of another type of drive mechanism which propels the transfer vehicle along the guide track between the various stations.

The transfer vehicle 28 can also be propelled along its guide path by means of the drive principles shown in FIG. 18. A tube 110 parallels the path of the guide track 24, and that tube 110 rotates about a central axis 111. A motor driven drive wheel 112 is secured to the transfer vehicle and is engageable with the rotating tube 110. The drive wheel 112 is mounted so that its axis 113 can be angularly changed relative to the central axis 111 of the tube 110. When the axis 113 of the drive wheel 112 is parallel to the axis 111 of the tube 110, the drive wheel 112 will spin, but the transfer vehicle 28 will not move along the guide track 24. When the axis 113 of the drive wheel 112 is disposed at an angle to the axis of the rotating tube 110 there is a component of force directed along the axis 110 of the tube in a direction parallel to the tube and the guide track 24. That component causes the transfer vehicle 28 to move along the guide track 24. The magnitude of that component varies directly with variations and the angle of the axis 113 of the drive wheel 112 relative to the axis 111 of the tube 110, so that the speed of movement of the transfer vehicle can be controlled by controlling the angle of the axis 113 of the drive wheel 112 relative to the axis 111 of the tube 110.

In the event that the clamped stack of signatures is not to be tied, but is simply to be delivered to a pallet or a container, the transfer vehicle 28 moves past the tying station 16 and brings the clamped stack of signatures directly to the pallet or container, which is also located along the guide track 24. The transfer vehicle then delivers the signatures directly to the pallet or container 120 (FIG. 1).

Figure 21:
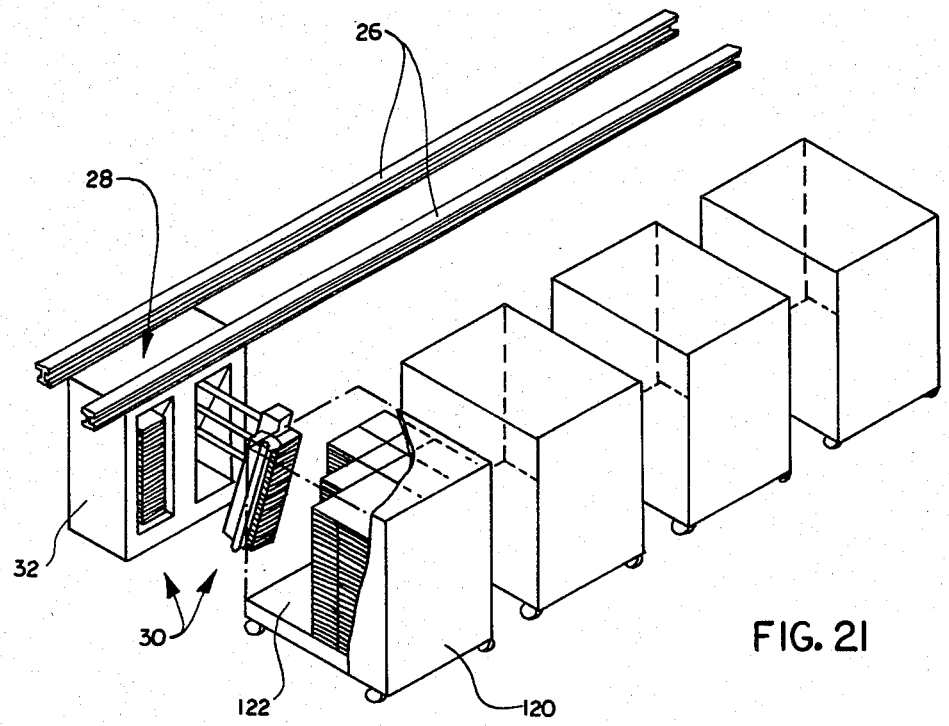
FIG. 21 schematically illustrates direct delivery of a stack of signatures to a container by the transfer vehicle.
Figure 22:
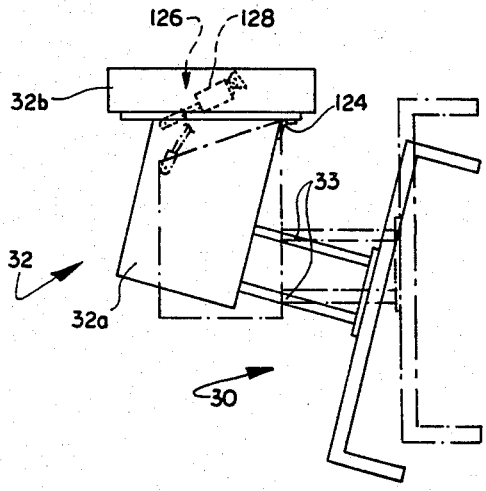
FIG. 22 schematically illustrates how the orientation of a stack of signatures is changed as the stack of signatures is delivered directly to a container.

When stacks of signatures are being transferred directly to a pallet or container (FIG. 21), it may be necessary to position the pallet or container 120 so that its bottom surface 122 is disposed horizontally. The clamping mechanism 30 may have to tilt from an inclined position (which it is in to remove a stack of signatures from a stacker) to a horizontal position to deliver the stack to the pallet or container. As shown by FIG. 22, the carriage 32 can be formed by two members 32*a*, 32*b* that are pivotally connected to each other by a joint 124. The member 32*b* is secured to the rails 26, and the member 32*a* is secured to the clamping mechanism 30. A linkage 126 extends between the members 32*a* and 32*b* and includes an air cylinder 128 which can be operated to tilt the carriage member 32*a*, from an inclined orientation (shown in full lines in FIG. 22) to a horizontal orientation (shown in phantom in FIG. 22). When the carriage member 320 is tilted to the horizontal position, the clamping mechanism 30 is also tilted to a horizontal orientation for delivering the stack directly to a pallet or container. After the stack has been delivered to the pallet or container, the air cylinder 128 is operated to tilt the carriage member 32*a* and the clamping mechanism 30 back to an inclined orientation.

It is contemplated that the movement of the transfer vehicle 28, and the operation of its clamping mechanisms 30 can be controlled from a remote location by an operator. Specifically, an operator can signal the transfer vehicle when it is desired to remove a stack of signatures from a stacker. The transfer vehicle can then proceed to the stacker, stopping first at the end board feeding station if necessary. At the stacker, the transfer vehicle clamps the stack, removes it from the stacker, and transports it to the tying station or to a container location as directed by the operator.

What is claimed is:

1. Apparatus comprising a stacker which receives a stream of signatures and forms the signatures into a stack, a transfer vehicle movable along a guide track to a stack pickup position adjacent said stacker, said transfer vehicle having a clamping mechanism which includes means for clamping a stack of signatures on a stacker and for removing the signatures from the stacker while said transfer vehicle is in said stack pickup position, said transfer vehicle being movable along said guide track from said stacker to a tying station to move a stack of signatures to the tying station, means for tying a stack of signatures at said tying station including means defining a strap guide for guiding a tying strap around the stack while the transfer vehicle is at the tying station, said means defining a guide comprising a first guide portion connected with said transfer vehicle and a second strap guide portion disposed at said tying station, said first and second strap guide portions cooperating to define said strap guide when said transfer vehicle is at said tying station.

2. Apparatus as set forth in claim 1 including a pair of tyer mechanisms disposed at said tying station, each tyer mechanism having a second strap guide portion associated therewith, said transfer vehicle being movable to respective stack delivery positions adjacent either of said pair of tyer mechanisms, and the second strap guide portion associated with each tyer mechanism cooperating with the first strap guide portion on said transfer vehicle to define a strap guide for a stack of signatures when the transfer vehicle is in a stack delivery position adjacent that tyer mechanism.

3. Apparatus as set forth in claim 2 including a pair of stackers provided at a stack pickup station, each of said stackers being adapted to form a stack of signatures, and said transfer vehicle being movable to respective stack pickup positions adjacent either of said pair of stackers so that said clamping mechanism can remove a stack of signatures therefrom.

4. Apparatus as set forth in claim 1 including a pair of stackers provided at a stack pickup station, each of said stackers being adapted to form a stack of signatures, and said transfer vehicle being movable to respective stack pickup positions adjacent either of said pair of stackers so that said clamping mechanism can remove a stack of signatures therefrom.

5. Apparatus comprising a transfer vehicle movable along a guide track between a stack pickup position and a stack delivery position, said transfer vehicle having a clamping mechanism for clamping a stack of signatures at the stack pickup position and for moving the stack of signatures from the stack pickup position, said clamping mechanism maintaining clamping engagement with the stack of signatures as said transfer vehicle is moved along the guide track away from the stack pickup position and to the stack delivery position, and said clamping mechanism being releasable from the stack of signatures at the stack delivery position, means at the stack delivery position for tying a stack of signatures when the transfer vehicle has moved a stack of signatures to said stack delivery position, and means defining a strap guide for guiding a tying strap around the stack while the transfer vehicle is at the stack delivery position, said means defining a strap guide comprising a first strap guide portion connected with said transfer vehicle and a second strap guide portion connected with said means for tying a stack of signatures, said first and second strap guide portions cooperating to define said strap guide when said transfer vehicle is at said stack delivery position.

6. Apparatus as set forth in claim 5 including a pair of means for tying a stack of signatures disposed at said stack delivery position, each means for tying a stack of signatures having a second strap guide portion associated therewith, said transfer vehicle being movable to a respective position adjacent either of said pair of means for tying a stack of signatures.

7. Apparatus comprising a transfer vehicle movable along a guide track between a stack pickup position and a stack delivery position, said transfer vehicle including a carriage movable along said guide track and a clamping mechanism for clamping a stack of signatures at the stack pickup position and for moving the stack of signatures from the stack pickup position, said clamping mechanism maintaining clamping engagement with the stack of signatures as said transfer vehicle is moved along the guide track away from the stack pickup position and to the stack delivery position, and said clamping mechanism being releasable from the stack of signatures at the stack delivery position, said clamping mechanism being secured to said carriage for movement therewith and relative thereto between retracted and extended positions, said clamping mechanism being movable from the retracted position to the extended position in which it can clampingly engage a stack of signatures when said transfer vehicle is at said stack pickup position, and said clamping mechanism being movable back to its retracted position while maintaining clamping engagement with a stack of signatures to allow the stack of signatures to be maintained in clamped condition as the stack is being moved to the stack delivery position.

8. Apparatus as set forth in claim 7, wherein a stacker for forming a stack of signatures is provided at said stack pickup position, said clamping mechanism being adapted to remove a stack of signatures from said stacker when said transfer vehicle is in said stack pickup position.

9. Apparatus as set forth in claim 8 including a pair of stackers provided at the stack pickup station, each of said stackers being adapted to form a stack of signatures, and said transfer vehicle being movable to respective stack pickup position adjacent either of said pair of stackers so that said clamping mechanism can remove a stack of signatures therefrom.

10. Apparatus as set forth in claim 7 including a signature receiving member provided at said stack delivery position, said clamping mechanism including means for depositing a stack of signatures on said signature receiving member at said stack delivery position.

11. Apparatus as set forth in claim 10 wherein said stacker supports a stack of signatures in an inclined orientation at said stack pickup position and said signature receiving member has a horizontal surface for receiving a stack of signatures, said clamping mechanism being movable between an inclined orientation for receiving a stack of signatures and a horizontal orientation for delivering the stack to said stack receiving member.

12. An apparatus as set forth in claim 11 wherein said carriage comprises a first carriage member secured to said guide track for movement therealong and a second carriage member pivotably connected with said first carriage member, said clamping mechanism being secured to said second carriage member for pivotal movement therewith between said inclined and horizontal orientations.

13. An apparatus as set forth in claim 12 further including means attached to said first carriage member for pivoting said second carriage member and thereby said clamping mechanism between said inclined and horizontal orientations.

14. Apparatus as set forth in claim 7 herein the signatures are stacked in face-to-face relation, and said clamping mechanism being adapted to apply a clamping force that clamps the adjacent faces of the signatures against each other.

15. An apparatus as set forth in claim 7 further including means for moving said clamping mechanism between said retracted and extended positions.

16. An apparatus as set forth in claim 15 wherein said means for moving said clamping mechanism between said retracted and extended positions comprises a motor means mounted on said carriage and rod means connected to said clamping mechanism and movable upon actuation of said motor means.

* * * * *